US005970841A

United States Patent [19]

Trocino

[11] Patent Number: 5,970,841

[45] Date of Patent: Oct. 26, 1999

[54] HUMANITARIAN DEMINING DEVICE

[76] Inventor: Joseph L. Trocino, 15233 Ventura Blvd., P-8, Sherman Oaks, Calif. 91403

[21] Appl. No.: 09/050,562

[22] Filed: Mar. 30, 1998

Related U.S. Application Data

[60] Provisional application No. 60/042,292, Apr. 1, 1997.

[51] Int. Cl.[6] ..... B64S 1/04

[52] U.S. Cl. ..... 89/1.13

[58] Field of Search ..... 89/1.13; 102/402, 102/403

[56] References Cited

U.S. PATENT DOCUMENTS

| | | | |
|---|---|---|---|
| H162 | 11/1986 | Sullivan, Jr. et al. | 102/403 |
| 2,925,038 | 2/1960 | Walker | 89/1.13 |
| 3,580,171 | 5/1971 | Maes et al. | 102/28 |
| 3,653,996 | 4/1972 | Edwards | 149/21 |
| 3,687,076 | 8/1972 | Fraint et al. | 102/24 |
| 3,724,319 | 4/1973 | Zebelka et al. | 89/1.13 |
| 4,823,672 | 4/1989 | Eidelman | 89/1.13 |
| 4,920,852 | 5/1990 | Miller | 86/1.1 |
| 4,967,636 | 11/1990 | Murray et al. | 89/1.13 |
| 5,063,848 | 11/1991 | Tucker et al. | 102/282 |
| 5,675,104 | 10/1997 | Schorr et al. | 89/1.13 |

*Primary Examiner*—Charles T. Jordan
*Assistant Examiner*—Jeffrey Howell
*Attorney, Agent, or Firm*—Roger A. Marrs

[57] ABSTRACT

A method and apparatus for handling a two-component explosive product which includes a bladder having an internal storage compartment with a nozzle inlet for receiving one component of the explosive material, such as liquid nitromethane. A removable cap is provided for sealing the nozzle inlet so that the bladder may be transported to the site of unexploded ordnance. At the site, a second of the two-component explosive material is added such as amine in either liquid or powder form or a dry sensitizer such as micro-balloons composed of glass or ceramic micro-spheres. These components are mixed together in the bladder. The cap is removed from the nozzle inlet in order to receive the introduction of the second component and then a detonator device is placed into the inlet nozzle. An actuator or energizer for the detonator is remotely located from the site of the unexploded ordnance and may be actuated at the discretion of the operator.

10 Claims, 1 Drawing Sheet

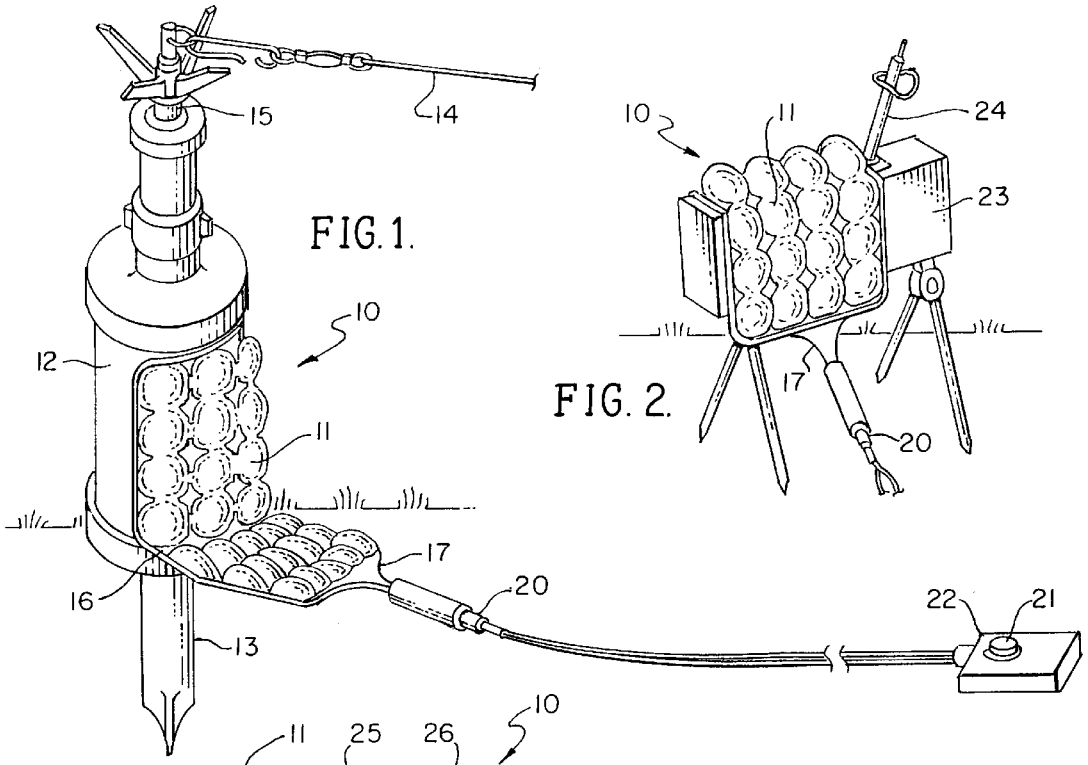
FIG. 1.
FIG. 2.
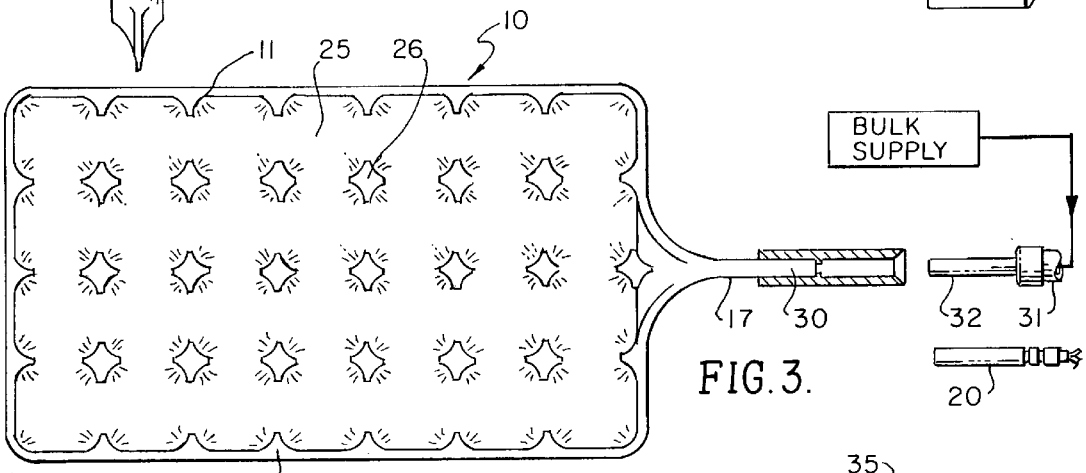
FIG. 3.
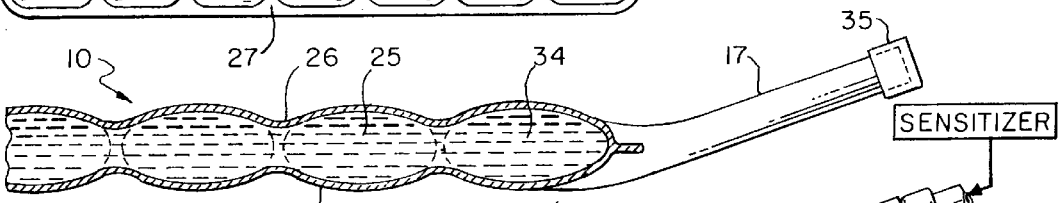
FIG. 4.
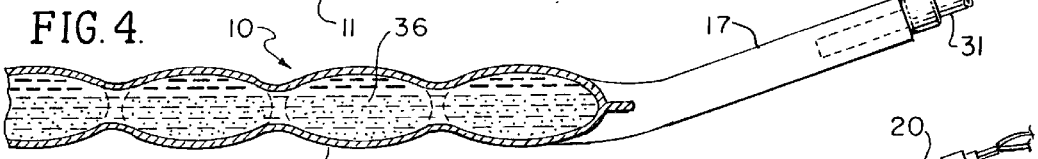
FIG. 5.
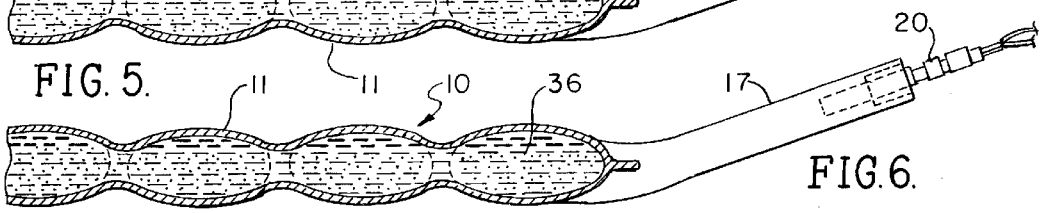
FIG. 6.

HUMANITARIAN DEMINING DEVICE

Priority claimed based on copending provisional application Ser. No. 60-042,292 filed Apr. 1, 1997

BACKGROUND OF THE INVENTION

1. Field of the Invention

The present invention relates to the field of explosive devices for humanitarian elimination of unexploded ordnance, and more particularly to a novel explosive package which is a safe and effective tool for controlled detonation or blow-in-place disposal of land mines and unexploded ordnance.

2. Brief Description of the Prior Art

Currently, there is a need to provide innovative techniques for land mine and unexploded ordnance neutralization and removal using powdered or liquid explosive materials employing sympathetic detonation techniques. The destruction of mines in place, whether buried, surface or above ground, is rapidly becoming the accepted method of permanently neutralizing unexploded ordnance including bobby-traps, land mines or the like. In the past, liquid explosive foams have been used. Such liquid explosive foam incorporates nitro-methane-based foam employing the use of aerosol technology and emulsion science. The energetic component comprises approximately 90 percent of the foam material. Although such foam explosives have been successful, other packages or devices for disposing of or neutralizing unexploded ordnance are needed for humanitarian demining. In humanitarian demining, it is generally accepted that upon detection of a land mine, for example, "blow-in-place" techniques will be used to neutralize the threat. This is generally done with high explosives, such as C-4, TNT block or the like or by directed energy, such as employing a shaped charge attack. The use of these techniques also has its drawbacks, including: the costs associated with the logistics of handling high explosives, the possible safety factors involved with placing explosives directly on an exposed land mine and the like.

Therefore, a long-standing need has existed to provide a humanitarian demining delivery system or device for neutralizing unexploded ordnance which may employ a two-component explosive material that can be transported separately and combined at the site of the unexploded ordnance for subsequent detonation. Such use of a two-component explosive material package must have the ability to properly separate or seal one component from a second component during transport while being adapted to accommodate introduction of the second component to the first component at the unexploded ordnance site followed by installation of a detonator which can be remotely actuated.

SUMMARY OF THE INVENTION

Accordingly, the above problems and difficulties are avoided by the present invention which provides a novel method and apparatus for handling a two-component or two-part explosive product which includes a bladder having an internal storage compartment with a nozzle inlet for receiving one component of the explosive material, such as liquid nitromethane. A removable cap is provided for sealing the nozzle inlet so that the bladder may be transported to the site of unexploded ordnance. At the site, the second of the two-component or part explosive material, such as amine in either liquid or powder form or a dry sensitizer such as micro-balloons composed of glass or ceramic microspheres. These can be introduced to the compartment within the bladder so as to mix with the compartmentalized liquid nitromethane. The removable cap is removed from the nozzle inlet in order to receive the introduction of the amine material or microballoon spheres and then a detonator device is placed into the inlet nozzle. An actuator or energizer for the detonator is remotely located from the site of the unexploded ordnance and may be actuated at the discretion of the operator.

Preferably, the bladder is composed of flexible material so that the package or device may be placed about the unexploded ordnance regardless of its shape or orientation. The bladder package or device may be draped over the ordnance or may be placed immediately adjacent thereto in order to be effective.

Therefore, it is among the primary objects of the present invention to provide a novel device useful in humanitarian demining of unexploded ordnance which is a safe and an effective tool for the destruction of unexploded ordnance in place for the purpose of permanently neutralizing land mines and unexploded ordnance.

Another object of the present invention is to provide a novel non-military explosive tool kit offering an explosive system that provides effectiveness, cost, safety, transportation, storage, environmental and other advantages over conventional explosives for a variety of applications.

A further object of the present invention is to provide an explosive kit which is adapted to handle a two-component explosive mixture adapted to handle a chemical sensitizer as well as a common solvent so that when mixed on site, the kit can be subsequently detonated to create a powerful and effective explosive device.

A further object resides in providing an explosive package which is adapted to hold a two-component explosive mixture and wherein the package includes a plurality of pocketed compartments which are interconnected and which is further composed of a flexible material so that the package may be wrapped or draped about an exploded ordnance intended to be rendered ineffective.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the novel humanitarian demining device incorporating the present invention;

FIG. 2 is a front perspective view of the device shown in FIG. 1 illustrated in another application for exploding the unexploded ordnance;

FIG. 3 is an enlarged plan view of the inventive humanitarian device package or bladder used in the invention shown in FIGS. 1 and 2;

FIG. 4 is a fragmentary cross-sectional view of the package or device shown in FIG. 3 illustrating the internal compartment held with one component of a two-component explosive mixture;

FIG. 5 is a view similar to the view of FIG. 4 illustrating introduction of a second component of the two-part or two-component explosive mixture into the bladder or device; and FIG. 6 is a view similar to the views of FIGS. 4 and 5 illustrating the package having a two-component explosive mixture within the internal storage compartment and illustrating a detonating device attached to the inlet nozzle.

DESCRIPTION OF THE PREFERRED EMBODIMENT

Referring to FIG. 1, the novel humanitarian demining device of the present invention is illustrated in the general direction of arrow 10 which includes a flexible package, pouch, bladder or the like which is broadly indicated by numeral 11. The device 10 is illustrated as being placed against an unexploded ordnance device 12 which is illustrated as being above ground and held in place by means of a buried spike 13. Normally, the device 12 may be detonated by means of a trip wire 14 which operates the detonator 15 incorporated into the device 12. In order to remove the device 12, the package of device 10 of the present invention is placed adjacent to or against the exterior surface of the housing of the device 12. To stabilize the device in this position, a portion may be folded about a midsection 16 so that a portion of the package or device rests on the ground as well.

It is to be noted that the package, bladder or device 11 includes an inlet nozzle 17 which will accommodate a cap in some instances, accommodate insertion of components for the two-component explosive material and accommodate the insertion of a detonating device, such as is illustrated by numeral 20. When it is desired to detonate the humanitarian demining device 10, a button 21 may be depressed on a control box 22 which houses the necessary circuitry for electronically igniting the detonator 20.

Referring now to FIG. 2, another version is illustrated where the humanitarian demining device 10 is illustrated as being draped over a different unexploded ordnance device 23. This device is different in shape than the shape of device 12 and it can be seen that the bladder, bag or device 10 may readily accommodate either shape or location. The unexploded ordnance device 23 includes a ring type detonator 24.

Referring now in detail to FIG. 3, the novel device 10 illustrates the bladder or bag 11 as being of plastic sheet construction having an internal compartment which is occupied by the components of the explosive material. Preferably, the internal compartment is divided into a plurality of individual pockets, such as pocket 25, by means of a plurality of compressed heat-seal areas 26 so that the plurality of pockets 25 are arranged in rows and columns. However, it is to be understood that the plurality of pockets are in communication with one another so that as a liquid component of the explosive is introduced into the storage compartment via the inlet nozzle 17, the liquid will flow through and between the respective pockets 25 to fully occupy the internal storage compartment. Also, the peripheral edge marginal region of the pair of sheets are heat-sealed together to form a peripheral seal and scene, as identified by numeral 27.

In order to introduce a liquid component of the explosive material into the storage compartment, an open-ended sleeve 30 may be placed over the inlet nozzle 17 so that a liquid dispensing unit 31 may inject the liquid component of the explosive product through a dispensing jet 32. The jet fits into the sleeve 30 and seals the lip so that the liquid will progress through the nozzle 17 into the storage compartment. Once the dispensing unit 31 has been removed, a detonator device 20 may be inserted into the inlet nozzle 17 or through the sleeve 30.

Referring now in detail to FIG. 4, it can be seen that the internal storage compartment of the bag or bladder device 11 is occupied by a first component of the two-component explosive material and such a component may be a liquid nitromethane and is broadly identified by numeral 34. Once the liquid has been introduced into the storage compartment and has flowed into the respective pockets 25, the injector 31 may be removed and a sealed closure cap 35 may be placed over the opening to the inlet nozzle 17. When in this condition, the bag or bladder may be transported from place to place without fear of premature ignition since only one component of the explosive mixture is being transported. Also, the detonator 20 is transported or shipped separately and does not come into contact with either of the two components being shipped or transported.

Referring to FIG. 5, once the filled bladder or bag has reached the site of the unexploded ordnance, the cap 35 is removed and the injector 31 is again inserted into the inlet nozzle 17 so that the second component of the two-component explosive material can be introduced into the storage compartment. In the present instance, either a powdered or liquid amine is introduced as a chemical "sensitizer" into the storage compartment for mixture with the liquid nitromethane component. Since the plastic material composing the sheets of the bag or bladder is flexible and may be stretched, the additional component is readily accepted into the storage compartment. The two-component explosive mixture is indicated by the numeral 36 and at this time, the bladder or bag may be draped or placed against the unexploded ordnance whether it takes the form of device 12 or the device 23. The injector 31 is removed and is replaced by the detonator 20, as shown in FIG. 6.

Referring to FIG. 6, alternately, the sensitizer may be micro-spheres or micro-balloons composed of glass or ceramic composition.

In FIG. 6, the detonator 20 is held in the inlet nozzle 17 and is ready for detonation by depression of switch or button 21.

In view of the foregoing, it can be seen that the humanitarian demining device of the present invention may be initially loaded at a remote location from the unexploded ordnance by placing a quantity of nitromethane into the storage compartment of the bladder or bag 10. After suitably capping with a seal cap 35, the bladder or bag may be transported separately or in bulk with other loaded packages. Once at the site of the unexploded ordnance, the cap 35 is removed followed by introducing a quantity of either powdered or liquid amine into the storage compartment of the bag or bladder via injector 31. Once mixture has occurred, the injector is removed and a detonator 20 is installed in the inlet nozzle 17. The flexible nature of the bag or bladder is such that it may be folded, draped or leaned against the unexploded ordnance and preferably, the bag or bladder will mate with the shape and conform to the external configuration of the unexploded ordnance device. Upon detonation, the explosion is of low density effect. Yet, a powerful and effective explosion eliminates and removes the previously unexploded ordnance from the site.

The liquid explosive of the present inventive system includes two non-explosive ingredients, combined on-site, to create a high performance explosive. The two ingredients may be: a. commercial grade nitromethane with a dye indicator and b. a chemical sensitizer, such as diethylenetriamine, amine or glass or ceramic micro-balloons or micro-spheres.

For on-site use, a pre-measured amount of sensitizer is poured into the flexible pouch. The remainder of the pouch is filled with nitromethane including a dye indicator whereby the composition will turn from the color yellow to that of purple. Next, a detonating cap is inserted into the pouch and the pouch is closed. The filled pouch is placed on the unexploded ordnance followed by the step of detonation.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A two-component explosive product comprising:

a pouch having an internal storage compartment;

a nozzle communicating said storage compartment exteriorly of said pouch;

said storage compartment adapted to receive a first chemical non-explosive component and a second chemical non-explosive component;

said first component and said second component characterized as being subject to explosion upon detonation;

said pouch being flexible and pliable;

said storage compartment divided into a plurality of intercommunicating pockets;

said pouch includes two pliable plastic sheets having edge marginal regions sealed together to define said storage compartment;

a plurality of sealed spots joining opposing surfaces of said plastic sheets together to provide said plurality of pockets;

said first component is liquid nitromethane and said second component is a sensitizer chosen from:

a. amine, either liquid or powder form; or b. micro-spheres of glass or ceramic; and a detonating means detachably engageable with said nozzle for selectively igniting said first component and said second component in said pouch.

2. The two-component explosive product defined in claim 1 including:

a closure cap interchangeable with said detonating means to seal and close said storage compartment.

3. A two-component explosive product comprising:

a first component consisting of a liquid nitromethane;

a second component consisting of a sensitizer of either an amine or micro-spheres of glass or ceramic;

a pouch having an inlet nozzle for accepting said first component and said second component for subsequent combining within said pouch; and a detonation means detachably connectable with said nozzle for selectively igniting the combined first component and said second component.

4. The two-component explosive product defined in claim 3 wherein:

said first component and said second component are separate ingredients introduced independent of each other into said pouch at the site of detonation.

5. The two-component explosive product defined in claim 4 wherein:

said pouch is flexible and pliable adapted to be wrapped or configured about unexploded ordnance and to assume the shape thereof.

6. The two-component explosive product defined in claim 5 wherein:

said first component consists of liquid nitromethane and said second component is chosen from either:

a. dry or liquid amine; or b. micro-spheres of glass or ceramic.

7. A method for elimination of an unexploded ordnance in situ comprising the steps of:

transporting a liquid first component of an explosive mixture to the site of the unexploded ordnance;

transporting a second component of an explosive mixture separate from the first component to tile site of the unexploded ordnance;

mixing the transported first and second components together in the compartment of a flexible container;

detonating the mixed components to eliminate the unexploded ordnance; and wrapping the flexible container carrying the mixed components about the exterior configuration of the unexploded ordnance.

8. The method defined in claim 7 wherein the detonation step includes:

inserting a detonator into the flexible container in contact with the mixed components.

9. The method defined in claim 8 wherein:

the transported liquid first component is bulk nitromethane and the transported second component is a sensitizer consisting of either amine or microspheres of glass or ceramic.

10. The method defined in claim 9 wherein the step of mixing includes the step of initially:

introducing a specific quantity of the transported bulk first component into the flexible container followed by introducing a specific quantity of the transported second component into the flexible container occupied by the specific quantity of the first component.

* * * * *